US011172551B2

(12) United States Patent
Hsia

(10) Patent No.: US 11,172,551 B2
(45) Date of Patent: Nov. 9, 2021

(54) SOLID-STATE LIGHTING WITH A DRIVER CONTROLLABLE BY A POWER-LINE DIMMER

(71) Applicant: Aleddra Inc., Renton, WA (US)

(72) Inventor: Chungho Hsia, Bellevue, WA (US)

(73) Assignee: Aleddra Inc., Renton, WA (US)

( * ) Notice: Subject to any disclaimer, the term of this patent is extended or adjusted under 35 U.S.C. 154(b) by 75 days.

(21) Appl. No.: 16/880,375

(22) Filed: May 21, 2020

(65) Prior Publication Data

US 2020/0288549 A1 Sep. 10, 2020

Related U.S. Application Data

(63) Continuation-in-part of application No. 16/861,137, filed on Apr. 28, 2020, now Pat. No. 10,992,161, which is a continuation-in-part of application No. 16/830,198, filed on Mar. 25, 2020, now Pat. No. 10,869,373, which is a continuation-in-part of application No. 16/735,410, filed on Jan. 6, 2020, now Pat. No. 10,660,179, which is a continuation-in-part of application No. 16/694,970, filed on Nov. 25, 2019, now Pat. No. 10,602,597, which is a continuation-in-part of application No. 16/681,740, filed on Nov. 12, 2019, now Pat. No. 10,959,310, which is a continuation-in-part of application No. 16/664,034, filed on Oct. 25, 2019, (Continued)

(51) Int. Cl.

| | |
|---|---|
| ***H05B 45/10*** | (2020.01) |
| ***H05B 45/30*** | (2020.01) |
| ***H05B 45/36*** | (2020.01) |
| ***H05B 45/34*** | (2020.01) |
| ***H05B 45/37*** | (2020.01) |

(52) U.S. Cl.

CPC ..... *H05B 45/10* (2020.01); *H05B 45/34* (2020.01); *H05B 45/36* (2020.01); *H05B 45/37* (2020.01)

(58) Field of Classification Search

CPC ..... H05B 45/10; H05B 45/30; H05B 45/31; H05B 45/32; H05B 45/36; H05B 45/37; H05B 47/10

See application file for complete search history.

(56) References Cited

U.S. PATENT DOCUMENTS

| | | | | |
|---|---|---|---|---|
| 7,902,769 | B2 * | 3/2011 | Shteynberg | H05B 45/345 315/291 |
| 9,648,676 | B2 * | 5/2017 | Angeles | H05B 45/3725 |
| 2013/0181624 | A1 * | 7/2013 | Kang | H05B 45/382 315/200 R |

* cited by examiner

*Primary Examiner* — Jimmy T Vu

(74) *Attorney, Agent, or Firm* — Han IP PLLC; Andy M. Han

(57) ABSTRACT

An LED luminaire comprises LED arrays, a full-wave rectifier, an LED driving circuit, and electric current bypass circuit(s). The full-wave rectifier is coupled to an external power-line dimmer which is coupled to the AC mains and configured to convert a phase-cut line voltage into a first DC voltage. With the electric current bypass circuit(s) to partially provide a holding current path to cause the external power-line dimmer to sustain a dimming function, the LED driving circuit can provide a second DC voltage with various driving currents according to various input power levels to drive LED arrays without flickering. By adapting switching frequencies and a duty cycle, the LED driving circuit can regulate the second DC voltage to reach a voltage level equal to or greater than a forward voltage of the LED arrays no matter whether the first DC voltage is higher or lower than the second DC voltage.

21 Claims, 3 Drawing Sheets

Related U.S. Application Data now Pat. No. 10,660,184, which is a continuation-in-part of application No. 16/572,040, filed on Sep. 16, 2019, now Pat. No. 10,645,782, which is a continuation-in-part of application No. 16/547,502, filed on Aug. 21, 2019, now Pat. No. 10,485,073, which is a continuation-in-part of application No. 16/530,747, filed on Aug. 2, 2019, now Pat. No. 10,492,265, which is a continuation-in-part of application No. 16/458,823, filed on Jul. 1, 2019, now Pat. No. 10,485,065, which is a continuation-in-part of application No. 16/432,735, filed on Jun. 5, 2019, now Pat. No. 10,390,396, which is a continuation-in-part of application No. 16/401,849, filed on May 2, 2019, now Pat. No. 10,390,395, which is a continuation-in-part of application No. 16/296,864, filed on Mar. 8, 2019, now Pat. No. 10,390,394, which is a continuation-in-part of application No. 16/269,510, filed on Feb. 6, 2019, now Pat. No. 10,314,123, which is a continuation-in-part of application No. 16/247,456, filed on Jan. 14, 2019, now Pat. No. 10,327,298, which is a continuation-in-part of application No. 16/208,510, filed on Dec. 3, 2018, now Pat. No. 10,237,946, which is a continuation-in-part of application No. 16/154,707, filed on Oct. 8, 2018, now Pat. No. 10,225,905, which is a continuation-in-part of application No. 15/947,631, filed on Apr. 6, 2018, now Pat. No. 10,123,388, which is a continuation-in-part of application No. 15/911,086, filed on Mar. 3, 2018, now Pat. No. 10,136,483, which is a continuation-in-part of application No. 15/897,106, filed on Feb. 14, 2018, now Pat. No. 10,161,616, which is a continuation-in-part of application No. 15/874,752, filed on Jan. 18, 2018, now Pat. No. 10,036,515, which is a continuation-in-part of application No. 15/836,170, filed on Dec. 8, 2017, now Pat. No. 10,021,753, which is a continuation-in-part of application No. 15/649,392, filed on Jul. 13, 2017, now Pat. No. 9,986,619, which is a continuation-in-part of application No. 15/444,536, filed on Feb. 28, 2017, now Pat. No. 9,826,595, which is a continuation-in-part of application No. 15/362,772, filed on Nov. 28, 2016, now Pat. No. 9,967,927, which is a continuation-in-part of application No. 15/225,748, filed on Aug. 1, 2016, now Pat. No. 9,743,484, which is a continuation-in-part of application No. 14/818,041, filed on Aug. 4, 2015, now Pat. No. 9,420,663, which is a continuation-in-part of application No. 14/688,841, filed on Apr. 16, 2015, now Pat. No. 9,288,867, which is a continuation-in-part of application No. 14/465,174, filed on Aug. 21, 2014, now Pat. No. 9,277,603, which is a continuation-in-part of application No. 14/135,116, filed on Dec. 19, 2013, now Pat. No. 9,163,818, which is a continuation-in-part of application No. 13/525,249, filed on Jun. 15, 2012, now Pat. No. 8,749,167.

SOLID-STATE LIGHTING WITH A DRIVER CONTROLLABLE BY A POWER-LINE DIMMER

CROSS-REFERENCE TO RELATED APPLICATIONS

The present disclosure is part of a continuation-in-part (CIP) application of U.S. patent application Ser. No. 16/861,137, filed 28 Apr. 2020, which is part of CIP application of U.S. patent application Ser. No. 16/830,198, filed 25 Mar. 2020, which is part of CIP application of U.S. patent application Ser. No. 16/735,410, filed 6 Jan. 2020 and issued as U.S. Pat. No. 10,660,179 on 19 May 2020, which is part of CIP application of U.S. patent application Ser. No. 16/694,970, filed 25 Nov. 2019 and issued as U.S. Pat. No. 10,602,597 on 24 Mar. 2020, which is part of CIP application of U.S. patent application Ser. No. 16/681,740, filed 12 Nov. 2019, which is part of CIP application of U.S. patent application Ser. No. 16/664,034, filed 25 Oct. 2019 and issued as U.S. Pat. No. 10,660,184 on 19 May 2020, which is part of CIP application of U.S. patent application Ser. No. 16/572,040, filed 16 Sep. 2019 and issued as U.S. Pat. No. 10,645,782 on 5 May 2020, which is part of CIP application of U.S. patent application Ser. No. 16/547,502, filed 21 Aug. 2019 and issued as U.S. Pat. No. 10,485,073 on 19 Nov. 2019, which is part of CIP application of U.S. patent application Ser. No. 16/530,747, filed 2 Aug. 2019 and issued as U.S. Pat. No. 10,492,265 on 26 Nov. 2019, which is part of CIP application of U.S. patent application Ser. No. 16/458,823, filed 1 Jul. 2019 and issued as U.S. Pat. No. 10,485,065 on 10 Nov. 2019, which is part of CIP application of U.S. patent application Ser. No. 16/432,735, filed 5 Jun. 2019 and issued as U.S. Pat. No. 10,390,396 on 20 Aug. 2019, which is part of CIP application of U.S. patent application Ser. No. 16/401,849, filed 2 May 2019 and issued as U.S. Pat. No. 10,390,395 on 20 Aug. 2019, which is part of CIP application of U.S. patent application Ser. No. 16/296,864, filed 8 Mar. 2019 and issued as U.S. Pat. No. 10,390,394 on 20 Aug. 2019, which is part of CIP application of U.S. patent application Ser. No. 16/269,510, filed 6 Feb. 2019 and issued as U.S. Pat. No. 10,314,123 on 4 Jun. 2019, which is part of CIP application of U.S. patent application Ser. No. 16/247,456, filed 14 Jan. 2019 and issued as U.S. Pat. No. 10,327,298 on 18 Jun. 2019, which is part of CIP application of U.S. patent application Ser. No. 16/208,510, filed 3 Dec. 2018 and issued as U.S. Pat. No. 10,237,946 on 19 Mar. 2019, which is part of CIP application of U.S. patent application Ser. No. 16/154,707, filed 8 Oct. 2018 and issued as U.S. Pat. No. 10,225,905 on 5 Mar. 2019, which is part of a CIP application of U.S. patent application Ser. No. 15/947,631, filed 6 Apr. 2018 and issued as U.S. Pat. No. 10,123,388 on 6 Nov. 2018, which is part of a CIP application of U.S. patent application Ser. No. 15/911,086, filed 3 Mar. 2018 and issued as U.S. Pat. No. 10,136,483 on 20 Nov. 2018, which is part of a CIP application of U.S. patent application Ser. No. 15/897,106, filed 14 Feb. 2018 and issued as U.S. Pat. No. 10,161,616 on 25 Dec. 2018, which is a CIP application of U.S. patent application Ser. No. 15/874,752, filed 18 Jan. 2018 and issued as U.S. Pat. No. 10,036,515 on 31 Jul. 2018, which is a CIP application of U.S. patent application Ser. No. 15/836,170, filed 8 Dec. 2017 and issued as U.S. Pat. No. 10,021,753 on 10 Jul. 2018, which is a CIP application of U.S. patent application of Ser. No. 15/649,392 filed 13 Jul. 2017 and issued as U.S. Pat. No. 9,986,619 on 29 May 2018, which is a CIP application of U.S. patent application Ser. No. 15/444,536, filed 28 Feb. 2017 and issued as U.S. Pat. No. 9,826,595 on 21 Nov. 2017, which is a CIP application of U.S. patent application Ser. No. 15/362,772, filed 28 Nov. 2016 and issued as U.S. Pat. No. 9,967,927 on 8 May 2018, which is a CIP application of U.S. patent application Ser. No. 15/225,748, filed 1 Aug. 2016 and issued as U.S. Pat. No. 9,743,484 on 22 Aug. 2017, which is a CIP application of U.S. patent application Ser. No. 14/818,041, filed 4 Aug. 2015 and issued as U.S. Pat. No. 9,420,663 on 16 Aug. 2016, which is a CIP application of U.S. patent application Ser. No. 14/688,841, filed 16 Apr. 2015 and issued as U.S. Pat. No. 9,288,867 on 15 Mar. 2016, which is a CIP application of U.S. patent application Ser. No. 14/465,174, filed 21 Aug. 2014 and issued as U.S. Pat. No. 9,277,603 on 1 Mar. 2016, which is a CIP application of U.S. patent application Ser. No. 14/135,116, filed 19 Dec. 2013 and issued as U.S. Pat. No. 9,163,818 on 20 Oct. 2015, which is a CIP application of U.S. patent application Ser. No. 13/525,249, filed 15 Jun. 2012 and issued as U.S. Pat. No. 8,749,167 on 10 Jun. 2014. Contents of the above-identified applications are incorporated herein by reference in their entirety.

BACKGROUND

Technical Field

The present disclosure relates to light-emitting diode (LED) luminaires and more particularly to an LED luminaire with a driver controllable by a power-line dimmer to regulate output power of the LED luminaire according to a phase angle of the power-line dimmer without flickering.

Description of the Related Art

Solid-state lighting from semiconductor light-emitting diodes (LEDs) has received much attention in general lighting applications today. Because of its potential for more energy savings, better environmental protection (with no hazardous materials used), higher efficiency, smaller size, and longer lifetime than conventional incandescent bulbs and fluorescent tubes, the LED-based solid-state lighting will be a mainstream for general lighting in the near future. Meanwhile, as LED technologies develop with the drive for energy efficiency and clean technologies worldwide, more families and organizations will adopt LED lighting for their illumination applications. In this trend, the potential health concerns such as temporal light artifacts become especially important and need to be well addressed.

In today's retrofit application of an LED luminaire to replace an existing fluorescent luminaire, consumers may choose either to adopt a ballast-compatible luminaire with an existing ballast used to operate the fluorescent luminaire or to employ an alternate current (AC) mains-operable LED luminaire by removing/bypassing the ballast. Either application has its advantages and disadvantages. In the former case, although the ballast consumes extra power, it is straightforward to replace the fluorescent luminaire without rewiring, which consumers have a first impression that it is the best alternative to the fluorescent luminaire. But the fact is that total cost of ownership for this approach is high regardless of very low initial cost. For example, the ballast-compatible luminaire works only with particular types of ballasts. If an existing ballast is not compatible with the ballast-compatible luminaire, the consumer will have to replace the ballast. Some facilities built long time ago incorporate different types of fixtures, which requires extensive labor for both identifying ballasts and replacing incompatible ones. Moreover, a ballast-compatible luminaire can operate longer than the ballast. When an old ballast fails, a new ballast will be needed to replace in order to keep the ballast-compatible luminaire working. Maintenance will be complicated, sometimes for the luminaires and sometimes for the ballasts. The incurred cost will preponderate over the initial cost savings by changeover to the ballast-compatible luminaire for hundreds of fixtures throughout a facility. When the ballast in a fixture dies, all the ballast-compatible luminaires in the fixture go out until the ballast is replaced. In addition, replacing a failed ballast requires a certified electrician. The labor costs and long-term maintenance costs will be unacceptable to end users. From energy saving point of view, the ballast constantly draws power, even when the ballast-compatible luminaires are dead or not installed. In this sense, any energy saved while using the ballast-compatible luminaire becomes meaningless with the constant energy use by the ballast. In the long run, the ballast-compatible luminaires are more expensive and less efficient than self-sustaining AC mains-operable luminaires.

On the contrary, an AC mains-operable luminaire does not require the ballast to operate. Before use of the AC mains-operable luminaire, the ballast in a fixture must be removed or bypassed. Removing or bypassing the ballast does not require an electrician and can be replaced by end users. Each AC mains-operable luminaire is self-sustaining. If one AC mains-operable luminaire in a fixture goes out, other luminaires or lamps in the fixture are not affected. Once installed, the AC mains-operable luminaire will only need to be replaced after 50,000 hours.

Light dimming can provide many benefits such as helping create an atmosphere by adjusting light levels, which reduces energy consumption and increases operating life of an LED lighting luminaire. Light dimmers are devices coupled to the lighting luminaire and used to lower the brightness of light. By changing the voltage waveform applied to the LED lighting luminaire, it is possible to lower the intensity of the light output, so called light dimming. Modern light dimmers are based on four dimming protocols, namely, mains dimming, DALI (Digital Addressable Lighting Interface), DMX (Digital Multiplex), and analog dimming, among which both DALI and DMX need a transmitter and a receiver. The analog dimming uses a direct current (DC) signal (0-10 V) between a control panel and an LED driver. As the signal voltage changes, the light output changes. However, the analog dimming needs an extra wire on a single channel basis when installed in a dimming system. Mains dimming, the oldest dimming protocol, is a type that can still widely be seen in homes, schools, and many other commercial places. A mains dimming system relies on reducing an input voltage to the LED lighting luminaire, typically by 'chopping-out' part of a line voltage from the AC mains, a so called phase-cut line voltage. There is no need to install the extra wire in an area that requires light dimming. Therefore, this disclosure will focus on the LED luminaire with a driver controllable by a mains dimmer (i.e., a power-line dimmer) and address how output power of the LED luminaire can be regulated according to a phase angle of the power-line dimmer without flickering.

SUMMARY

An LED luminaire comprises a driver and one or more LED arrays. The driver comprises a power supply section and an LED driving circuit. The power supply section comprises a full-wave rectifier, at least one input filter, and at least one electric current bypass circuit. The full-wave rectifier is coupled to an external power-line dimmer which is coupled to AC mains and configured to convert a phase-cut line voltage into a first DC voltage. With the at least one electric current bypass circuit to partially provide a first holding current path to cause the external power-line dimmer to sustain a dimming function, the LED driving circuit can provide a second DC voltage with various driving currents according to various input power levels to drive LED arrays without flickering. By adapting switching frequencies and a duty cycle, the LED driving circuit can regulate the second DC voltage to reach a voltage level equal to or greater than a forward voltage of the LED arrays no matter whether the first DC voltage is higher or lower than the second DC voltage.

The one or more LED arrays comprise a positive potential terminal and a negative potential terminal with a forward voltage across thereon. The power supply section further comprises at least two electrical conductors "T" and "N" configured to couple to an external power-line dimmer which is coupled to the AC mains. The external power-line dimmer is configured to phase-cut a sinusoidal waveform in a line voltage from the AC mains and outputs a phase-cut line voltage. The at least one full-wave rectifier 301 comprises a ground reference and is configured to convert the phase-cut line voltage from the external power-line dimmer into a first DC voltage.

The power supply section further comprises at least one electric current bypass circuit comprising a first resistor and a first capacitor connected in series with the first resistor. The at least one electric current bypass circuit is coupled to the at least one input filter and configured to provide the first holding current path to cause the external power-line dimmer to sustain the dimming function when controlling the LED driving current. The at least one input filter comprises an input capacitor and a filter assembly comprising an input inductor and a second capacitor and is configured to suppress an electromagnetic interference (EMI) noise. The filter assembly may further comprise multiple such combinations of the input inductor and the second capacitor. The filter assembly may be configured to linearize the LED driving circuit so that the external power-line dimmer can be more operable with the LED driving circuit. In this case, an initial current of the phase-cut line voltage from the external power-line dimmer is retarded with the first DC voltage built up less abruptly and with the initial current surge reduced. This substantially improves compatibility between the external power-line dimmer and the LED driving circuit such that the LED driving circuit is more controllable by the external power-line dimmer. Specifically, the at least one electric current bypass circuit is coupled in parallel with the second capacitor. Note that the dimming function of the external power-line dimmer is essential to dim up and dim down the LED luminaire without flickering. The at least one electric current bypass circuit provides the first holding current path to cause the external power-line dimmer to sustain the dimming function with stability.

The LED driving circuit comprises a control device with a DC voltage input port, an electronic switch with on-time and off-time controlled by the control device, an output inductor with current charging and discharging controlled by the electronic switch 403, an output capacitor coupled to the output inductor, a diode coupled between the electronic switch and the output capacitor, and at least one current sensing resistor coupled to the control device. The LED driving circuit is coupled to the at least one full-wave rectifier via the at least one input filter and the at least one electric current bypass circuit and configured to convert the first DC voltage into a second DC voltage with an LED driving current to drive the one or more LED arrays.

The electronic switch is configured to modulate the first DC voltage at a switching frequency with on-time and off-time controlled by the control device. The output inductor is coupled to the electronic switch with current charging and discharging controlled by the electronic switch. In other words, the output inductor is further configured to be charged over the on-time and discharged over the off-time. Since an average current from the output inductor is equal to sum of an input current from the first DC voltage and the LED driving current, part of the average current from the output inductor yields to the LED driving current to drive the one or more LED arrays. In this case, the second DC voltage has a reverse polarity relative to the first DC voltage. Specifically, responsive to detecting zero current in the output inductor 404, the control device is configured to generate a zero current detection signal to control the electronic switch on and off with a duty cycle controlling the second DC voltage and the LED driving current to drive the one or more LED arrays. The duty cycle is thereby configured to regulate the second DC voltage to reach a voltage level equal to or greater than the forward voltage no matter whether the first DC voltage is higher or lower than the second DC voltage. The LED driving circuit is further configured to provide the LED driving current to drive the one or more LED arrays according to an input power level supplied by the phase-cut line voltage from the AC mains.

In FIG. 1, when the input current goes into the output inductor, energy is stored in it. When the electronic switch is off, the diode is forward-biased, and the output inductor releases the energy stored, resulting in a loop current flowing from the output inductor, the diode, and the one or more LED arrays back to the output inductor, completing the energy transfer to the one or more LED arrays. When the electronic switch is on, the input current flows from the output inductor and the electronic switch, energy is stored in the output inductor whereas the diode is reverse-biased, no current flowing into the one or more LED arrays. At the same time, part of the input current flows into the at least one current sensing resistor, creating a sensing voltage across the at least one current sensing resistor. The sensing voltage goes to the control device to control the off-time of the electronic switch. When the electronic switch is off, the diode is forward-biased, and the output inductor discharges with a loop current flowing from the output inductor, the diode, and the one or more LED arrays back to the output inductor. The process repeats and the energy continues to transfer to the one or more LED arrays. The at least one current sensing resistor keeps track of the output current and feedbacks to the control device to further control the electronic switch on and off. The closed loop operation in both on-time and off-time of the electronic switch ensures the output current to be accurately controlled.

The LED driving circuit further comprises a second resistor and a third capacitor connected in series with the second resistor. The second resistor and the third capacitor are configured to provide a second holding current path to cause the external power-line dimmer to sustain the dimming function when controlling the LED driving current. The second resistor is configured to couple to the positive potential terminal whereas the third capacitor is configured to couple to the DC voltage input port with respect to the ground reference. The LED driving circuit is enabled when a voltage across the third capacitor reaches an operating voltage of the control device. The LED driving circuit further comprises an output resistor coupled in parallel with the output capacitor. The output resistor and the output capacitor are configured to build up the second DC voltage. On the other hand, when the phase-cut line voltage from the AC mains is first inputted, the output resistor is configured to supply the first DC voltage to the control device via the second resistor and to start up the control device.

The LED driving circuit further comprises a transistor circuit coupled to the positive potential terminal and configured to extract part of the second DC voltage to sustain operating the control device. The transistor circuit comprises a transistor and a voltage regulator coupled to the transistor. The transistor is turned on when the second DC voltage reaches a predetermined level set by the voltage regulator. The transistor circuit further comprises one or more resistors and connected in series, wherein the one or more resistors and are configured to create a voltage bias to operate the transistor and to set up a voltage for the transistor to launch into the DC voltage input port via the transistor. In this case, the transistor circuit is further configured to provide a third holding current path to cause the external power-line dimmer to sustain the dimming function even when the electronic switch is turned off.

BRIEF DESCRIPTION OF THE DRAWINGS

Non-limiting and non-exhaustive embodiments of the present disclosure are described with reference to the following figures, wherein like names refer to like parts but their reference numerals differ throughout the various figures unless otherwise specified. Moreover, in the section of detailed description of the invention, any of a "first", a "second", a "third", and so forth does not necessarily represent a part that is mentioned in an ordinal manner, but a particular one.

DETAILED DESCRIPTION OF VARIOUS EMBODIMENTS

Figure 1:
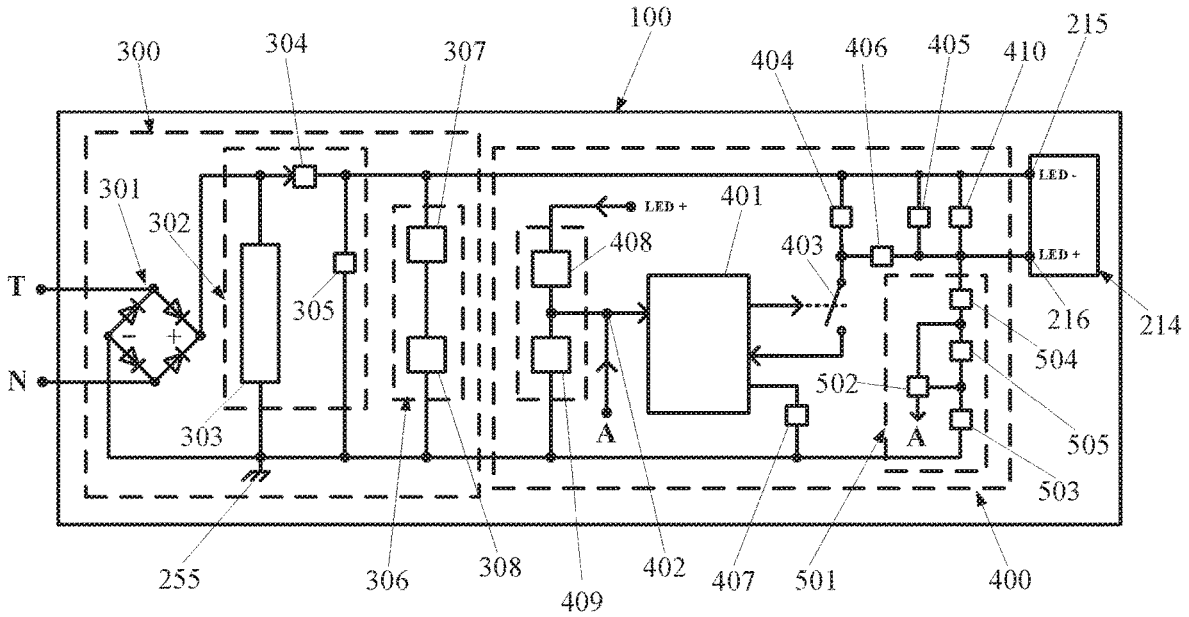
FIG. 1 is a block diagram of an LED luminaire according to the present disclosure.

FIG. 1 is a block diagram of an LED luminaire according to the present disclosure. The LED luminaire 100 comprises one or more LED arrays 214, a power supply section 300, and an LED driving circuit 400. The one or more LED arrays 214 comprise a positive potential terminal 216 and a negative potential terminal 215 with a forward voltage across thereon. The power supply section 300 comprises at least two electrical conductors "T" and "N", at least one full-wave rectifier 301, and at least one input filter 302. The at least two electrical conductors "T" and "N" are configured to couple to an external power-line dimmer (not shown) which is coupled to the AC mains. The external power-line dimmer is configured to phase-cut a sinusoidal waveform in a line voltage from the AC mains and outputs a phase-cut line voltage. The at least one full-wave rectifier 301 comprises a ground reference 255 and is configured to convert the phase-cut line voltage from the external power-line dimmer into a first DC voltage.

In FIG. 1, the power supply section 300 further comprises at least one electric current bypass circuit 306 comprising a first resistor 307 and a first capacitor 308 connected in series with the first resistor 307. The at least one electric current bypass circuit 306 is coupled to the at least one input filter 302 and configured to provide a first holding current path to cause the external power-line dimmer to sustain the dimming function when controlling the LED driving current. The at least one input filter 302 comprises an input capacitor 303 and a filter assembly comprising an input inductor 304 and a second capacitor 305 and is configured to suppress an EMI noise. The filter assembly may further comprise multiple such combinations of the input inductor 304 and the second capacitor 305. The filter assembly may be configured to linearize the LED driving circuit 400 so that the external power-line dimmer can be more operable with the LED driving circuit 400. In this case, an initial current of the phase-cut line voltage from the external power-line dimmer is retarded with the first DC voltage built up less abruptly and with the initial current surge reduced. This substantially improves compatibility between the external power-line dimmer and the LED driving circuit 400. Specifically, the at least one electric current bypass circuit 306 is coupled in parallel with the second capacitor 305. Note that the dimming function of the external power-line dimmer is essential to dim up and dim down the LED luminaire 100 without flickering. The at least one electric current bypass circuit 306 provides the first holding current path to cause the external power-line dimmer to sustain the dimming function with stability.

In FIG. 1, the LED driving circuit 400 comprises a control device 401 with a DC voltage input port 402, an electronic switch 403 with on-time and off-time controlled by the control device 401, an output inductor 404 with current charging and discharging controlled by the electronic switch 403, an output capacitor 405 coupled to the output inductor 404, a diode 406 coupled between the electronic switch 403 and the output capacitor 405, and at least one current sensing resistor 407 coupled to the control device 401. The LED driving circuit 400 is coupled to the at least one full-wave rectifier 301 via the at least one input filter 302 and the at least one electric current bypass circuit 306 and configured to convert the first DC voltage into a second DC voltage with an LED driving current to drive the one or more LED arrays 214.

In FIG. 1, the electronic switch 403 is configured to modulate the first DC voltage at a switching frequency with on-time and off-time controlled by the control device 401. The output inductor 404 is coupled to the electronic switch 403 with current charging and discharging controlled by the electronic switch 403. In other words, the output inductor 404 is further configured to be charged over the on-time and discharged over the off-time. Since an average current from the output inductor 404 is equal to sum of an input current from the first DC voltage and the LED driving current, part of the average current from the output inductor 404 yields to the LED driving current to drive the one or more LED arrays 214. In this case, the second DC voltage has a reverse polarity relative to the first DC voltage, as can be seen in FIG. 1. Specifically, responsive to detecting zero current in the output inductor 404, the control device 401 is configured to generate a zero current detection signal to control the electronic switch 403 on and off with a duty cycle controlling the second DC voltage and the LED driving current to drive the one or more LED arrays 214. The duty cycle is thereby configured to regulate the second DC voltage to reach a voltage level equal to or greater than the forward voltage no matter whether the first DC voltage is higher or lower than the second DC voltage. The LED driving circuit 400 is further configured to provide the LED driving current to drive the one or more LED arrays 214 according to an input power level supplied by the phase-cut line voltage.

In FIG. 1, when the input current goes into the output inductor 404, energy is stored in it. When the electronic switch 403 is off, the diode 406 is forward-biased, and the output inductor 404 releases the energy stored, resulting in a loop current flowing from the output inductor 404, the diode 406, and the one or more LED arrays 214 back to the output inductor 404, completing the energy transfer to the one or more LED arrays 214. When the electronic switch 403 is on, the input current flows from the output inductor 404 and the electronic switch 403, energy is stored in the output inductor 404 whereas the diode 406 is reverse-biased, no current flowing into the one or more LED arrays 214. At the same time, part of the input current flows into the at least one current sensing resistor 407, creating a sensing voltage across the at least one current sensing resistor 507. The sensing voltage goes to the control device 401 to control the off-time of the electronic switch 403. When the electronic switch 403 is off, the diode 406 is forward-biased, and the output inductor 404 discharges with a loop current flowing from the output inductor 404, the diode 406, and the one or more LED arrays 214 back to the output inductor 404. The process repeats and the energy continues to transfer to the one or more LED arrays 214. The at least one current sensing resistor 407 keeps track of the output current and feedbacks to the control device 401 to further control the electronic switch 403 on and off. The closed loop operation in both on-time and off-time of the electronic switch 403 ensures the output current to be accurately controlled.

In FIG. 1, the LED driving circuit 400 further comprises a second resistor 408 and a third capacitor 409 connected in series with the second resistor 408. The second resistor 408 and the third capacitor 409 are configured to provide a second holding current path to cause the external power-line dimmer to sustain the dimming function when controlling the LED driving current. The second resistor 408 is configured to couple to the positive potential terminal 216 whereas the third capacitor 409 is configured to couple to the DC voltage input port 402 at one end and the ground reference 255 at the other end. The LED driving circuit 400 is enabled when a voltage across the third capacitor 409 reaches an operating voltage of the control device 401. The LED driving circuit 400 further comprises an output resistor 410 coupled in parallel with the output capacitor 405. The output resistor 410 and the output capacitor 405 are configured to build up the second DC voltage. On the other hand, when the phase-cut line voltage from the AC mains is first inputted, the output resistor 410 is configured to supply the first DC voltage to the control device 401 via the second resistor 408 and to start up the control device 401.

In FIG. 1, the LED driving circuit 400 further comprises a transistor circuit 501 coupled to the positive potential terminal 216 and configured to extract part of the second DC voltage to sustain operating the control device 401. The transistor circuit 501 comprises a transistor 502 and a voltage regulator 503 coupled to the transistor 502. The transistor 502 is turned on when the second DC voltage reaches a predetermined level set by the voltage regulator 503. The transistor circuit 501 further comprises one or more resistors 504 and 505 connected in series, wherein the one or more resistors 504 and 505 are configured to create a voltage bias to operate the transistor 502 and to set up a voltage for the transistor 502 to launch into the DC voltage input port 402 via the transistor 502 and a port "A". In this case, the transistor circuit 501 is further configured to provide a third holding current path to cause the external power-line dimmer to sustain the dimming function even when the electronic switch 403 is turned off.

Figure 2:
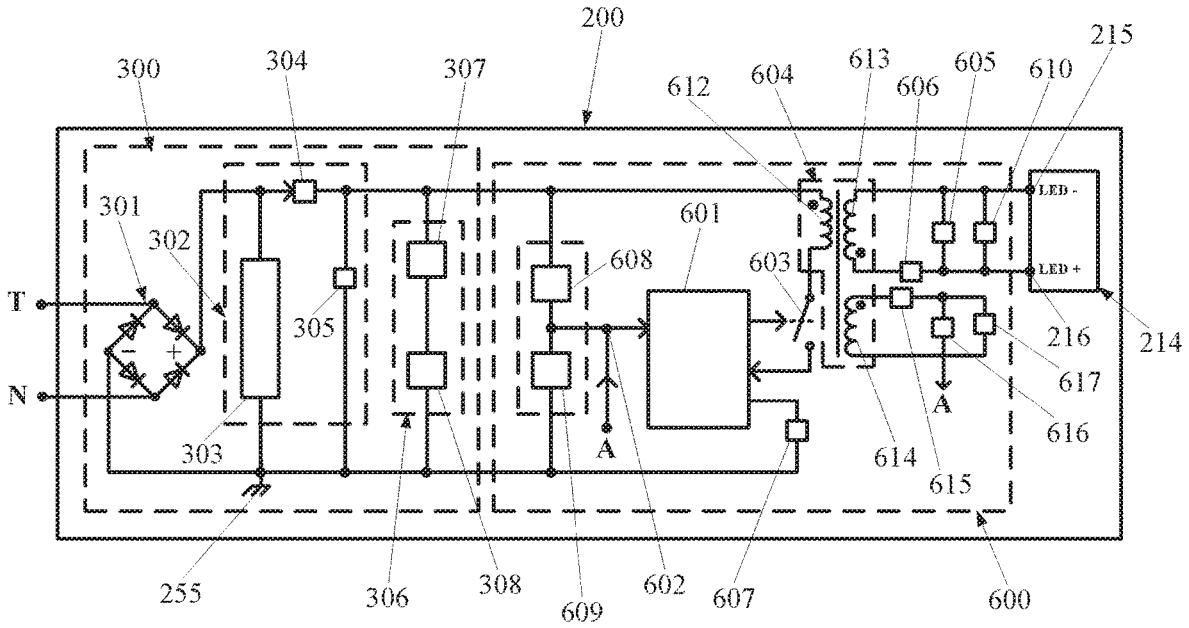
FIG. 2 is a block diagram of another embodiment of the LED luminaire according to the present disclosure.

FIG. 2 is a block diagram of another embodiment of the LED luminaire according to the present disclosure. FIG. 2 has almost all the components as in FIG. 1, except that a transformer 604 replaces the output inductor 404 in FIG. 1, that the transistor circuit 501 in FIG. 1 is removed, and that the second resistor 408 in FIG. 1 is reconfigured to couple to the first DC voltage instead of the positive potential terminal 216. In FIG. 2, the same numerals are used for the same components as in FIG. 1 unless specified otherwise.

In FIG. 2, an LED luminaire 200 comprises one or more LED arrays 214, a power supply section 300, and an LED driving circuit 600. The one or more LED arrays 214 comprise a positive potential terminal 216 and a negative potential terminal 215 with a forward voltage across thereon. The power supply section 300 comprises at least two electrical conductors "T" and "N", at least one full-wave rectifier 301, and at least one input filter 302. The at least two electrical conductors "T" and "N" are configured to couple to an external power-line dimmer (not shown) which is coupled to the AC mains. The external power-line dimmer is configured to phase-cut a sinusoidal waveform in a line voltage from the AC mains and outputs a phase-cut line voltage. The at least one full-wave rectifier 301 comprises a ground reference 255 and is configured to convert the phase-cut line voltage from the external power-line dimmer into a first DC voltage.

In FIG. 2, the power supply section 300 further comprises at least one electric current bypass circuit 306 comprising a first resistor 307 and a first capacitor 308 connected in series with the first resistor 307. The at least one electric current bypass circuit 306 is coupled to the at least one input filter 302 and configured to provide a first holding current path to cause the external power-line dimmer to sustain the dimming function when controlling the LED driving current. The at least one input filter 302 comprises an input capacitor 303 and a filter assembly comprising an input inductor 304 and a second capacitor 305 and is configured to suppress an electromagnetic interference (EMI) noise. The filter assembly may further comprise multiple such combinations of the input inductor 304 and the second capacitor 305. The filter assembly may be configured to linearize the LED driving circuit 600 so that the external power-line dimmer can be more operable with the LED driving circuit 600. In this case, an initial current of the phase-cut line voltage from the external power-line dimmer is retarded with the first DC voltage built up less abruptly and with the initial current surge reduced. This substantially improves compatibility between the external power-line dimmer and the LED driving circuit 600. Specifically, the at least one electric current bypass circuit 306 is coupled in parallel with the second capacitor 305. Note that the dimming function of the external power-line dimmer is essential to dim up and dim down the LED luminaire 200 without flickering. The at least one electric current bypass circuit 306 provides the first holding current path to cause the external power-line dimmer to sustain the dimming function with stability.

In FIG. 2, the LED driving circuit 600 comprises a control device 601 with a DC voltage input port 602, an electronic switch 603 with on-time and off-time controlled by the control device 601, a transformer 604 comprising a primary winding 612 and a secondary winding 613, an output capacitor 605 coupled to the secondary winding 613, a first diode 606 coupled between the secondary winding 613 and the output capacitor 605, and at least one current sensing resistor 607 coupled to the control device 601. The LED driving circuit 600 is coupled to the at least one full-wave rectifier 301 via the at least one input filter 302 and the at least one electric current bypass circuit 306 and configured to convert the first DC voltage into a second DC voltage with an LED driving current to drive the one or more LED arrays 214. The primary winding 612 is coupled to the electronic switch 603 with current charging and discharging controlled by the electronic switch 603.

In FIG. 2, the electronic switch 603 is configured to modulate the first DC voltage at a switching frequency with on-time and off-time controlled by the control device 601. The primary winding 612 is coupled to the electronic switch 603 with current charging and discharging controlled by the electronic switch 603. In other words, the primary winding 612 is further configured to be charged over the on-time and discharged over the off-time. Since an average current from the primary winding 612 is equal to sum of an input current from the first DC voltage and the LED driving current in the secondary winding 613, part of the average current from the primary winding 612 yields to the LED driving current induced in the secondary winding to drive the one or more LED arrays 214. Specifically, responsive to detecting zero current in the primary winding 612, the control device 601 is configured to generate a zero current detection signal to control the electronic switch 603 on and off with a duty cycle controlling the second DC voltage and the LED driving current to drive the one or more LED arrays 214. The duty cycle is thereby configured to regulate the second DC voltage to reach a voltage level equal to or greater than the forward voltage no matter whether the first DC voltage is higher or lower than the second DC voltage. The LED driving circuit 600 is further configured to provide the LED driving current to drive the one or more LED arrays 214 according to an input power level supplied by the phase-cut line voltage. In FIG. 2, the second DC voltage generated in the secondary winding 613 followed by the first diode 606 and the output capacitor 605 creates a reverse polarity relative to the first DC voltage, as can be seen that dot-marked terminals in the primary winding 612 and the secondary winding 613 are one up and one down (i.e., 180 degrees out of phase).

In FIG. 2, the LED driving circuit 600 further comprises a second resistor 608 and a third capacitor 609 connected in series with the second resistor 608. The second resistor 608 and the third capacitor 609 are configured to provide a second holding current path to cause the external power-line dimmer to sustain the dimming function when controlling the LED driving current. The second resistor 608 is configured to couple to the first DC voltage whereas the third capacitor 609 is configured to couple to the DC voltage input port 602 at one end and the ground reference 255 at the other end. The LED driving circuit 600 is enabled when a voltage across the third capacitor 609 reaches an operating voltage of the control device 601. The LED driving circuit 600 further comprises an output resistor 610 coupled in parallel with the output capacitor 605. The output resistor 610 and the output capacitor 605 are configured to build up the second DC voltage. On the other hand, when the phase-cut line voltage from the AC mains is first inputted, the second resistor 608 is configured to supply the first DC voltage to the control device 601 and to start up the control device 601. Same as the LED driving circuit 400 in FIG. 1, the LED driving circuit 600 is further configured to provide various LED driving currents to drive the one or more LED arrays 214 according to various input power levels of the phase-cut line voltage.

In FIG. 2, the transformer 604 further comprises an auxiliary winding 614 whereas the LED driving circuit 600 further comprises a voltage feedback circuit comprising a second diode 615, a third diode 616, and a stabilizing capacitor 617. The voltage feedback circuit is configured to draw partial energy from the auxiliary winding 614. Specifically, the second diode 615 is configured to rectify energy pulses induced in the auxiliary winding 614 into a DC voltage whereas the third diode 616 is configured to control a current flowing into to the DC voltage input 602 via the port "A" to sustain operation of the control device 601.

Figure 3:
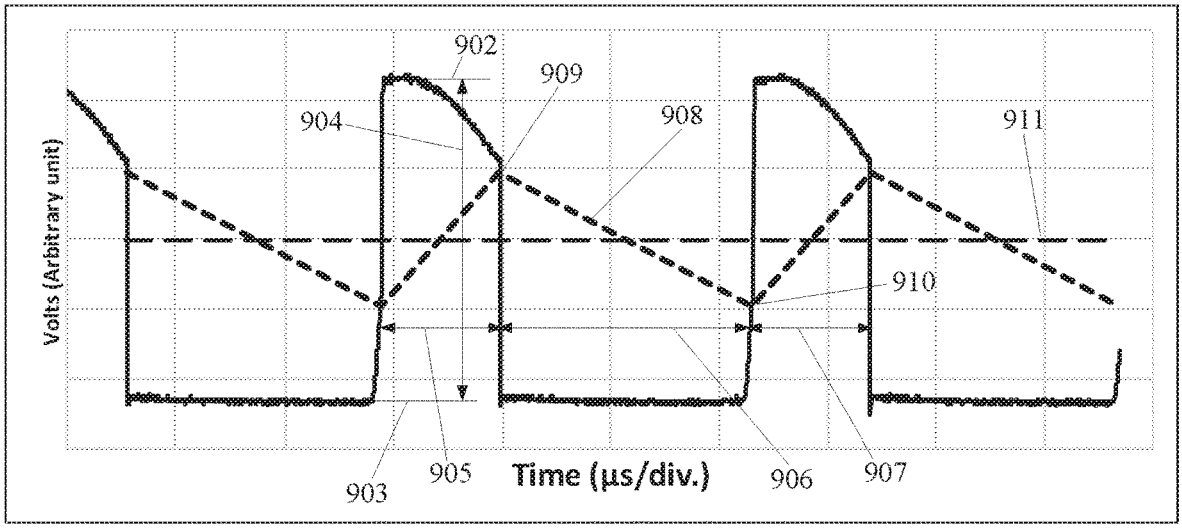
FIG. 3 is a first set of waveforms measured across an output inductor according to the present disclosure.

FIG. 3 is a first set of waveforms measured across an output inductor according to the present disclosure. Referring to FIG. 1, when a phase-cut line voltage of 120 V (volts) at an input power level of 100% of a rated maximum (i.e., a phase angle of 0 degree) is applied, the bridge rectifier 301 and the at least one input filter 302 provide the first DC voltage of 158 V. The output inductor 404 (FIG. 1) is charged when the electronic switch 403 is on. The high level 902 represents the first DC voltage. The low level 903 represents $-V_o$, where $V_o$ is the second DC voltage across the one or more LED arrays 214. The minus (−) sign in front of $V_o$ means that the second DC voltage has a reverse polarity relative to the first DC voltage. In other words, the peak-to-peak voltage 904 between the high level 902 and the low level 903 is sum of the first DC voltage and the second DC voltage. The waveforms in FIG. 3 comprise multiple main pulses with a first width 905 of 11 microseconds (μs), a second width 906 of 23 μs, and a third width 907 of 11 μs. The first width 905 and the third width 907 represent the on-time, which is constant. The second width 906 then represents the off-time, which is varied. The output inductor 404 is discharged when the electronic switch 403 is off. As seen in FIG. 3, an inductor current 908 increases linearly with the on-time from the zero current when charged, reaching the maximum inductor current ($I_{pk}$) at the end of the on-time 909, then starting to discharge from the maximum inductor current ($I_{pk}$) during off-time. At the end of discharge cycle 910, the inductor current 908 decreases to zero, and the control device 401 detects the zero current and turns on the electronic switch 403 for a next charging cycle. An average inductor current 911 then represents sum of an input current and a desired output current to operate the LED arrays 214. For the first DC voltage of 158 V rectified from the at least one rectifier 301 and filtered from the at least one input filter 302 (FIG. 1), the on-time is fixed at 11 μs, whereas the off-time of the electronic switch 403 varies as determined by the zero inductor current. In FIG. 3, the off-time period 906 of 23 μs appears between the first width 905 and the third width 907. Thus, a corresponding switching frequency is 29.2 kHz. This means that hundreds of inductor charging cycles are used in each half cycle of the line voltage from the AC mains. However, the switching frequency may slightly vary from 29.2 kHz because the off-time varies according to variations of the first DC voltage further due to variations of the phase-cut line voltage. In FIG. 3, a duty cycle of 0.32 gives a desired output voltage $V_o$ (i.e., the second DC voltage) and a first constant output current, yielding a regulated maximum power to operate the one or more LED arrays 214 when the LED driving circuit 400 operates.

Figure 4:
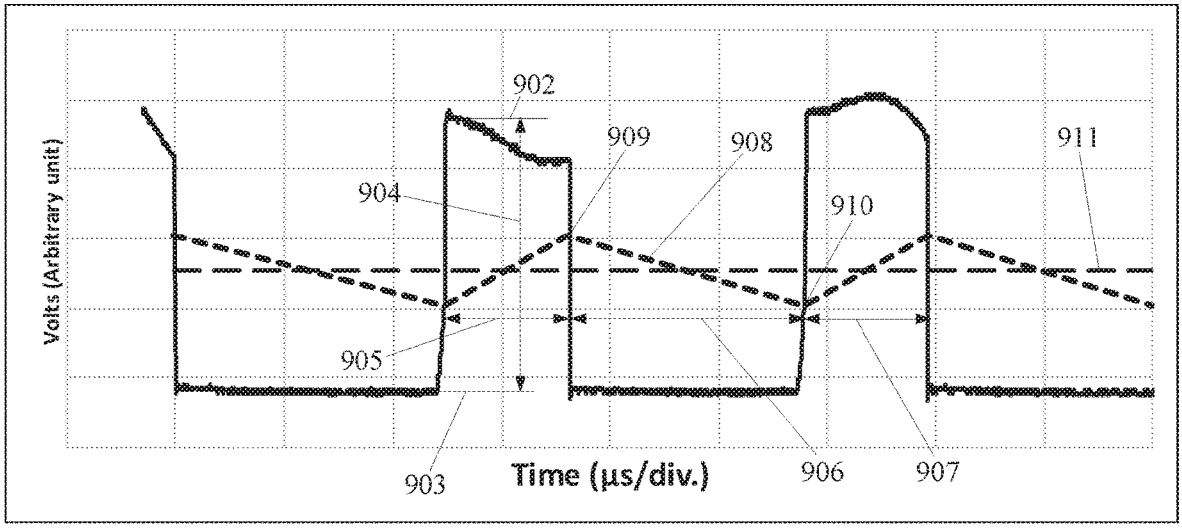
FIG. 4 is a second set of waveforms measured across an output inductor according to the present disclosure.

FIG. 4 is a second set of waveforms measured across an output inductor when input power is cut in half according to the present disclosure. In FIG. 4, the same numerals are used for the same components as in FIG. 3 unless specified otherwise. Referring to FIG. 1, when a phase-cut line voltage of 120 V at an input power level of 50% of the rated maximum (i.e., a phase angle of 90 degree) is applied, the bridge rectifier 301 and the at least one input filter 302 provide the first DC voltage of 135 V. The output inductor 404 is charged when the electronic switch 403 is on. The high level 902 represents the first DC voltage. The low level 903 represents $-V_o$, where $V_o$ is the second DC voltage across the one or more LED arrays 214. In other words, the peak-to-peak voltage 904 between the high level 902 and the low level 903 is sum of the first DC voltage and the second DC voltage. The waveforms in FIG. 4 comprise multiple main pulses with the first width 905 of a nominal value of 11 μs, the second width 906 of 21.6 μs, and the third width 907 of the nominal value of 11 μs. Both the first width 905 and the third width 907 represent the on-time, which is constant. The second width 906 then represents the off-time, which is varied. The output inductor 404 is discharged when the electronic switch 403 is off. As seen in FIG. 4, the inductor current 908 increases linearly with the on-time from the zero current when charged, reaching the maximum inductor current ($I_{pk}$) at the end of the on-time 909, then starting to discharge from the maximum inductor current ($I_{pk}$) during off-time. At the end of discharge cycle 910, the inductor current 908 decreases to zero, and the control device 401 detects the zero current and turns on the electronic switch 403 for a next charging cycle. The average inductor current 911 then represents sum of an input current and a desired output current to operate the LED arrays 214. For the first DC voltage of 135 V rectified from the at least one rectifier 301 and filtered from the at least one input filter 302 (FIG. 1), the on-time is fixed at the nominal value of 11 μs, whereas the off-time of the electronic switch 403 varies as determined by the zero inductor current. In FIG. 4, the off-time period 906 of 22.6 μs appears between the first width 905 and the third width 907. Thus, a corresponding switching frequency is 30 kHz. This means that hundreds of inductor charging cycles are used in each half cycle of the phase-cut line voltage. However, the switching frequency may slightly vary from 30 kHz because the off-time varies according to variations of the first DC voltage further due to variations of the phase-cut line voltage. In FIG. 4, a duty cycle of 0.348 gives a desired output voltage $V_o$ (i.e., the second DC voltage) and a second constant output current, yielding a regulated half power to operate the one or more LED arrays 214 when the LED driving circuit 400 operates.

Figure 5:
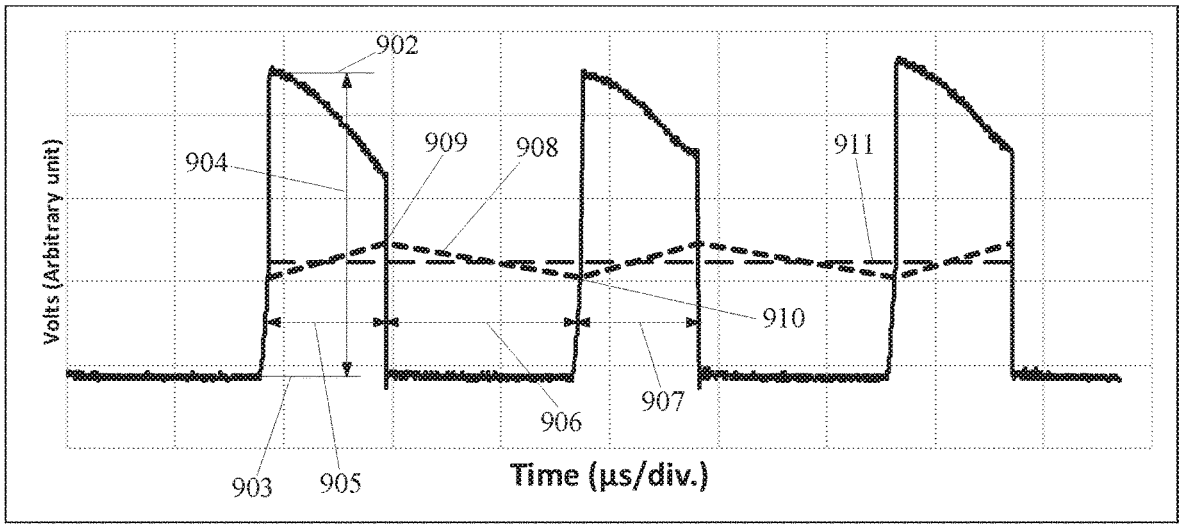
FIG. 5 is a third set of waveforms measured across an output inductor according to the present disclosure.

FIG. 5 is a third set of waveforms measured across an output inductor when input power is cut 82% according to the present disclosure. In FIG. 5, the same numerals are used for the same components as in FIG. 3 unless specified otherwise. Referring to FIG. 1, when a phase-cut line voltage of 120 V at an input power level of 18% (cut 82%) of the rated maximum (i.e., a phase angle of 130 degree) is applied, the bridge rectifier 301 and the at least one input filter 302 provide the first DC voltage of 110 V. The output inductor 404 is charged when the electronic switch 403 is on. The high level 902 represents the first DC voltage. The low level 903 represents $-V_o$, where $V_o$ is the second DC voltage across the one or more LED arrays 214. In other words, the peak-to-peak voltage 904 between the high level 902 and the low level 903 is sum of the first DC voltage and the second DC voltage. The waveforms in FIG. 5 comprise multiple main pulses with the first width 905 of a nominal value of 11 μs, the second width 906 of 18 μs, and the third width 907 of the nominal value of 11 μs. Both the first width 905 and the third width 907 represent the on-time, which is constant.

The second width 906 then represents the off-time, which is varied. The output inductor 404 is discharged when the electronic switch 403 is off. As seen in FIG. 5, the inductor current 908 increases linearly with the on-time from the zero current when charged, reaching the maximum inductor current ($I_{pk}$) at the end of the on-time 909, then starting to discharge from the maximum inductor current ($I_{pk}$) during off-time. At the end of discharge cycle 910, the inductor current 908 decreases to zero, and the control device 401 detects the zero current and turns on the electronic switch 403 for a next charging cycle. The average inductor current 911 then represents sum of an input current and a desired output current to operate the LED arrays 214. For the first DC voltage of 110 V rectified from the at least one rectifier 301 and filtered from the at least one input filter 302, the on-time is fixed at the nominal value of 11 μs, whereas the off-time of the electronic switch 403 varies as determined by the zero inductor current. In FIG. 5, the off-time period 906 of 18 μs appears between the first width 905 and the third width 907. Thus, a corresponding switching frequency is 34.4 kHz. This means that hundreds of inductor charging cycles are used in each half cycle of the phase-cut line voltage. However, the switching frequency may slightly vary from 34.4 kHz because the off-time varies according to variations of the first DC voltage further due to variations of the phase-cut line voltage. In FIG. 5, a duty cycle of 0.375 gives a desired output voltage $V_o$ (i.e., the second DC voltage) and a third constant output current, yielding a regulated 18% of the maximum rated power to operate the one or more LED arrays 214 when the LED driving circuit 400 operates. As can be seen in FIGS. 3-5, the LED driving circuit 400 can provide various LED driving currents to drive the one or more LED arrays 214 according to various input power levels of the phase-cut line voltage.

Whereas preferred embodiments of the present disclosure have been shown and described, it will be realized that alterations, modifications, and improvements may be made thereto without departing from the scope of the following claims. Another LED driving circuit controllable by a power-line dimmer in an LED-based luminaire using various kinds of combinations to accomplish the same or different objectives could be easily adapted for use from the present disclosure. Accordingly, the foregoing descriptions and attached drawings are by way of example only and are not intended to be limiting.

What is claimed is:

1. A light-emitting diode (LED) luminaire, comprising:

one or more LED arrays comprising a positive potential terminal and a negative potential terminal with a forward voltage across thereon;

at least one full-wave rectifier comprising a ground reference, the at least one full-wave rectifier configured to couple to an external power-line dimmer which is coupled to alternate-current (AC) mains and to convert a phase-cut line voltage from the external power-line dimmer into a first direct-current (DC) voltage;

at least one input filter coupled to the at least one full-wave rectifier and configured to suppress an electromagnetic interference (EMI) noise;

an LED driving circuit comprising a control device with a DC voltage input port, an electronic switch with on-time and off-time controlled by the control device, an output inductor with current charging and discharging controlled by the electronic switch, an output capacitor coupled to the output inductor, a diode coupled between the electronic switch and the output capacitor, and at least one current sensing resistor, wherein the LED driving circuit is coupled to the at least one full-wave rectifier via the at least one input filter and configured to convert the first DC voltage into a second DC voltage with an LED driving current to drive the one or more LED arrays; and at least one electric current bypass circuit comprising a first resistor and a first capacitor connected in series with the first resistor, the at least one electric current bypass circuit coupled to the at least one input filter and configured to provide a first holding current path to cause the external power-line dimmer to sustain a dimming function when controlling the LED driving current, wherein:

the electronic switch is configured to modulate the first DC voltage at a switching frequency controlled by the control device;

the second DC voltage has a reverse polarity relative to the first DC voltage; and the LED driving circuit is further configured to provide various LED driving currents to drive the one or more LED arrays according to various input power levels of the phase-cut line voltage.

2. The LED luminaire of claim 1, wherein the at least one input filter comprises an input capacitor and a filter assembly, the filter assembly comprising one or more combinations of an input inductor and a second capacitor, the filter assembly configured to reduce an initial current surge and to improve compatibility between the external power-line dimmer and the LED driving circuit.

3. The LED luminaire of claim 1, wherein the LED driving circuit further comprises a second resistor and a third capacitor connected in series with the second resistor, the second resistor and the third capacitor configured to provide a second holding current path to cause the external power-line dimmer to sustain the dimming function when controlling the LED driving current.

4. The LED luminaire of claim 3, wherein the second resistor is configured to couple to the positive potential terminal, wherein the third capacitor is configured to couple to the DC voltage input port with respect to the ground reference, and wherein the LED driving circuit is enabled when a voltage across the third capacitor reaches an operating voltage of the control device.

5. The LED luminaire of claim 3, wherein the LED driving circuit further comprises an output resistor coupled in parallel with the output capacitor, the output resistor and the output capacitor configured to build up the second DC voltage, and wherein the output resistor is configured to supply the first DC voltage to the control device via the second resistor and to start up the control device.

6. The LED luminaire of claim 1, wherein the LED driving circuit further comprises a transistor circuit coupled to the positive potential terminal and configured to draw partial energy from the second DC voltage to operate the control device.

7. The LED luminaire of claim 6, wherein the transistor circuit comprises a transistor and a voltage regulator coupled to the transistor, and wherein the transistor is turned on when the second DC voltage reaches a predetermined level set by the voltage regulator.

8. The LED luminaire of claim 7, wherein the transistor circuit further comprises one or more resistors connected in series, wherein the one or more resistors are configured to create a voltage bias to operate the transistor and to set up a voltage for the transistor to launch into the DC voltage input port, and wherein the transistor circuit is further configured to provide a third holding current path to cause the external power-line dimmer to sustain the dimming function when controlling the LED driving current to operate the one or more LED arrays.

9. The LED luminaire of claim 1, wherein the output inductor is further configured to be charged over the on-time and discharged over the off-time, and wherein a part of an average current from the output inductor yields to the LED driving current to drive the one or more LED arrays.

10. The LED luminaire of claim 9, wherein, responsive to detecting zero current in the output inductor, the control device is configured to generate a zero current detection signal to control the electronic switch on and off with a duty cycle controlling the second DC voltage and the LED driving current to drive the one or more LED arrays.

11. The LED luminaire of claim 10, wherein the duty cycle is configured to regulate the second DC voltage to reach a voltage level equal to or greater than the forward voltage no matter whether the first DC voltage is higher or lower than the second DC voltage.

12. The LED luminaire of claim 1, further comprising the external power-line dimmer which comprises a triode for alternating current (TRIAC) dimmer or a silicon controlled rectifier (SCR) dimmer.

13. A light-emitting diode (LED) luminaire, comprising:

one or more LED arrays comprising a positive potential terminal and a negative potential terminal with a forward voltage across thereon;

at least one full-wave rectifier comprising a ground reference, the at least one full-wave rectifier configured to couple to an external power-line dimmer which is coupled to alternate-current (AC) mains and to convert a phase-cut line voltage from the external power-line dimmer into a first direct-current (DC) voltage;

at least one input filter coupled to the at least one full-wave rectifier and configured to suppress an electromagnetic interference (EMI) noise;

an LED driving circuit comprising a control device with a DC voltage input port, an electronic switch with on-time and off-time controlled by the control device, a transformer comprising a primary winding and a secondary winding, an output capacitor coupled to the secondary winding, a first diode coupled between the secondary winding and the output capacitor, and at least one current sensing resistor, wherein the LED driving circuit is coupled to the at least one full-wave rectifier via the at least one input filter and configured to convert the first DC voltage into a second DC voltage with an LED driving current to drive the one or more LED arrays, and wherein the primary winding is coupled to the electronic switch with current charging and discharging controlled by the electronic switch;

at least one electric current bypass circuit comprising a first resistor and a first capacitor connected in series with the first resistor, the at least one electric current bypass circuit coupled in parallel with the at least one input filter and configured to provide a first holding current path to cause the external power-line dimmer to sustain a dimming function when controlling the LED driving current, wherein:

the electronic switch is configured to modulate the first DC voltage at a switching frequency controlled by the control device;

the second DC voltage has a reverse polarity relative to the first DC voltage; and the LED driving circuit is further configured to provide various LED driving currents to drive the one or more LED arrays according to various input power levels of the phase-cut line voltage.

14. The LED luminaire of claim 13, wherein the at least one input filter comprises an input capacitor and a filter assembly, the filter assembly comprising one or more combinations of an input inductor and a second capacitor, the filter assembly configured to reduce an initial current surge and to improve compatibility between the external power-line dimmer and the LED driving circuit.

15. The LED luminaire of claim 13, wherein the LED driving circuit further comprises a second resistor and a third capacitor connected in series with the second resistor, the second resistor and the third capacitor configured to provide a second holding current path to cause the external power-line dimmer to sustain the dimming function when controlling the LED driving current.

16. The LED luminaire of claim 15, wherein the second resistor is configured to couple to the first DC voltage, wherein the third capacitor is configured to couple to the DC voltage input port with respect to the ground reference, and wherein the LED driving circuit is enabled when a voltage across the third capacitor reaches an operating voltage of the control device.

17. The LED luminaire of claim 13, wherein the primary winding is further configured to be charged over the on-time and discharged over the off-time, and wherein a part of an average current flowing through the primary winding yields to the LED driving current induced in the secondary winding to drive the one or more LED arrays.

18. The LED luminaire of claim 17, wherein, responsive to detecting zero current in the primary winding, the control device is configured to generate a zero current detection signal to control the electronic switch on and off with a duty cycle controlling the second DC voltage and the LED driving current to drive the one or more LED arrays.

19. The LED luminaire of claim 18, wherein the duty cycle is configured to regulate the second DC voltage to reach a voltage level equal to or greater than the forward voltage no matter whether the first DC voltage is higher or lower than the second DC voltage.

20. The LED luminaire of claim 13, wherein the transformer further comprises an auxiliary winding, wherein the LED driving circuit further comprises a second diode and a third diode coupled to the second diode, and wherein the second diode is coupled to the auxiliary winding and configured to draw partial energy from the auxiliary winding and to deliver the partial energy to the control device via the third diode to operate the control device.

21. The LED luminaire of claim 13, further comprising the external power-line dimmer which comprises a triode for alternating current (TRIAC) dimmer or a silicon controlled rectifier (SCR) dimmer.

* * * * *